US006209299B1

(12) United States Patent
Landry et al.

(10) Patent No.: US 6,209,299 B1
(45) Date of Patent: Apr. 3, 2001

(54) DOUBLE TWIST TWINNER WITH BACK-TWIST PAY OFFS AND INTERMEDIATE CAPSTAN

(75) Inventors: Ernest L. Landry, Leominster; Timothy P. McKeon, East Brookfield, both of MA (US)

(73) Assignee: Thermoplastics Engineering Corp., Leominster, MA (US)

( * ) Notice: Subject to any disclaimer, the term of this patent is extended or adjusted under 35 U.S.C. 154(b) by 0 days.

(21) Appl. No.: 09/305,343

(22) Filed: Apr. 30, 1999

(51) Int. Cl.[7] ..... D01H 1/10

(52) U.S. Cl. ..... 57/58.54; 57/3; 57/6; 57/16; 57/58.49; 57/58.52; 57/58.54; 57/59; 57/127.5; 57/294; 174/27; 174/110; 174/113

(58) Field of Search ..... 57/3, 6, 16, 58.49, 57/58.52, 58.54, 59, 127.5, 294; 174/27, 110, 113

(56) References Cited

U.S. PATENT DOCUMENTS

| | | | |
|---|---|---|---|
| 3,732,682 | 5/1973 | Crotty et al. | 57/59 |
| 3,969,880 | 7/1976 | Maillefer et al. | 57/6 |
| 4,044,538 | 8/1977 | Hoside | 57/62 |
| 4,182,105 | 1/1980 | Tokuji | 57/58.54 |
| 4,233,807 | 11/1980 | Venable | 57/58.52 |
| 5,619,016 | 4/1997 | Newmoyer | 174/113 |
| 5,622,039 * | 4/1997 | Thompson | 57/3 |
| 5,767,441 | 6/1998 | Brorein et al. | 174/27 |
| 5,814,768 | 9/1998 | Wessels et al. | 174/110 |
| 5,966,917 * | 10/1999 | Thompson | 57/58.49 |

FOREIGN PATENT DOCUMENTS

| | | | |
|---|---|---|---|
| 459 621 | 10/1981 | (SE) | 13/2 |

* cited by examiner

*Primary Examiner*—John J. Calvert
*Assistant Examiner*—Shaun R. Hurley
(74) *Attorney, Agent, or Firm*—Hamilton, Brook, Smith & Reynolds, P.C.

(57) ABSTRACT

An apparatus is provided comprising a first twisting device that dispenses a first wire and imparts a twist to the same, a second twisting device that receives the twisted first wire and twists the same about a second wire, and a metering device or capstan positioned on the outside of the second twisting device that controls the input velocity of the first and second wires. The apparatus can further include a third twisting device that dispenses a second wire and imparts a twist to the same. In a preferred embodiment of the present invention, the first and second wires are back-twisted and the second twisting device receives the first and second back-twisted wires and twins or pairs the same. A tension transducer is also provided which measures the tension of the wires before they enter the second twisting device. That measurement is forwarded to a controller which issues an inverse control signal to a take-up motor of the second twisting device to minimize tension oscillations on the wires within the twinning device.

18 Claims, 11 Drawing Sheets

DOUBLE TWIST TWINNER WITH BACK-TWIST PAY OFFS AND INTERMEDIATE CAPSTAN

BACKGROUND OF THE INVENTION

Electrical cables are commonly used to transmit analog signals and digital data. These cables often include a pre-twisted pair of wires to improve electrical and mechanical properties. These pre-twisted wires are cabled or paired together in a cabling device at typically high speeds which impart significant forces, e.g, tension, to the wires often deforming them.

Industry specifications dictating the strain on wires during cabling are stringent, e.g., the wire's conductor cannot be stretched more than 1/10,000 of an inch measured across the diameter. These specifications can result in a substantial amount of discarded wire.

U.S. Pat. No. 3,969,880 to Maillefer et al. describes a cabler that incorporates a capstan or pulling device inside of a rotating doubletwisting bow. The wire is twisted as the wire enters the bow, and then is fed down one side of the bow and twisted again at the other side of the bow after which the wire is taken up. At higher speeds, the capstan must pull the wire with higher tensile forces due to the frictional forces acting on the wire through the bow. This often pulls the wire out of specification.

Another prior art system avoids using a capstan and pulls the wire through the bow using the take-up reel. This system suffers from the same deficiency in that the wire is pulled through the bow with increased tension as the rotational speed of the bow increases often resulting in damaged wire.

SUMMARY OF THE INVENTION

Accordingly, a need exists for a cabler device which pulls wire through a rotating bow with minimal tensile force.

A need also exists for a cabler device which can counteract and minimize oscillating forces acting on the wire through the bow.

An apparatus to accomplish the foregoing comprises a first twisting device that dispenses a first wire and imparts a pre-twist to the same, a second twisting device that receives the twisted first wire and twists the same about a second wire. A metering device or capstan positioned on the outside of the second twisting device controls the input velocity of the first and second wires. The apparatus can further include a third twisting device that dispenses the second wire and imparts a pre-twist to the same. In a preferred embodiment of the present invention, the second twisting device receives the first and second wires and twins or pairs the same. Preferably, the first and third twisting devices impart a respective back-twist to the first and second wires.

A transducer that measures the tension of the first and second wires before the second twisting device twins the same is provided in accordance with the present invention. The tension measurement is forwarded to a controller.

According to other aspects of the present invention, a take-up reel and motor are provided on the second twisting device to take-up the twinned first and second wires. The take-up reel motor rotates in response to a control signal from the controller to thereby control the tension of the first and second wires through the second twisting device.

According to further aspects of the present invention, the second twisting device includes a traverse assembly to lay the wires onto a take-up reel. The traverse assembly includes a damping mechanism to maintain the tension in the wires substantially constant in a preferred embodiment.

The first and third twisting devices each include a pay-off reel that dispenses the first and second wires, each pay-off reel being rotated by a respective pay-off reel motor. The first and third twisting devices each further include a damping mechanism that takes up slack in the dispensing of the first and second wires.

Each twisting device includes a bow assembly rotated by a respective motor for twisting the wires. In a preferred embodiment of the present invention, each twisting device is vertically oriented.

A dancer assembly, which can also be referred to as a buffer assembly, is associated with the first and third twisting devices for taking up slack in the dispensing of the first and second wires and thereby control tension and velocity of the same.

An apparatus is also provided including first twisting means for dispensing a first wire and imparting a twist to the same, second twisting means for receiving the twisted first wire and twisting the same about a second wire. Metering means is positioned on the outside of the second twisting device for controlling the input velocity of the first and second wires. The apparatus can further include third twisting means for dispensing the second wire and imparting a twist to the same. Transducer means is also provided for measuring the tension of the first and second wires before the second twisting twists the same. This measurement is forwarded to a controller which controls the tension or torque of the take-up reel motor such that the tension through the second twisting means is substantially constant.

Also in accordance with the present invention, a method of twisting wire is provided comprising measuring the tension of a wire before it enters a twisting device, forwarding the tension measurement to a controller, and controlling the torque of a take-up reel in response to a set of programmed instructions. The take-up reel takes up the twisted wire in response to the tension measurement such that the tension in the twisting device is substantially constant. The method further includes the step of controlling the input speed of the wire with a capstan positioned before the wire enters the twisting device. In a preferred embodiment of the present invention, the wire is back-twisted before entering the twisting device.

According to yet a further aspect of the present invention, a back-twist is imparted to a second wire wherein the first and second wires are twinned in the twisting device.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
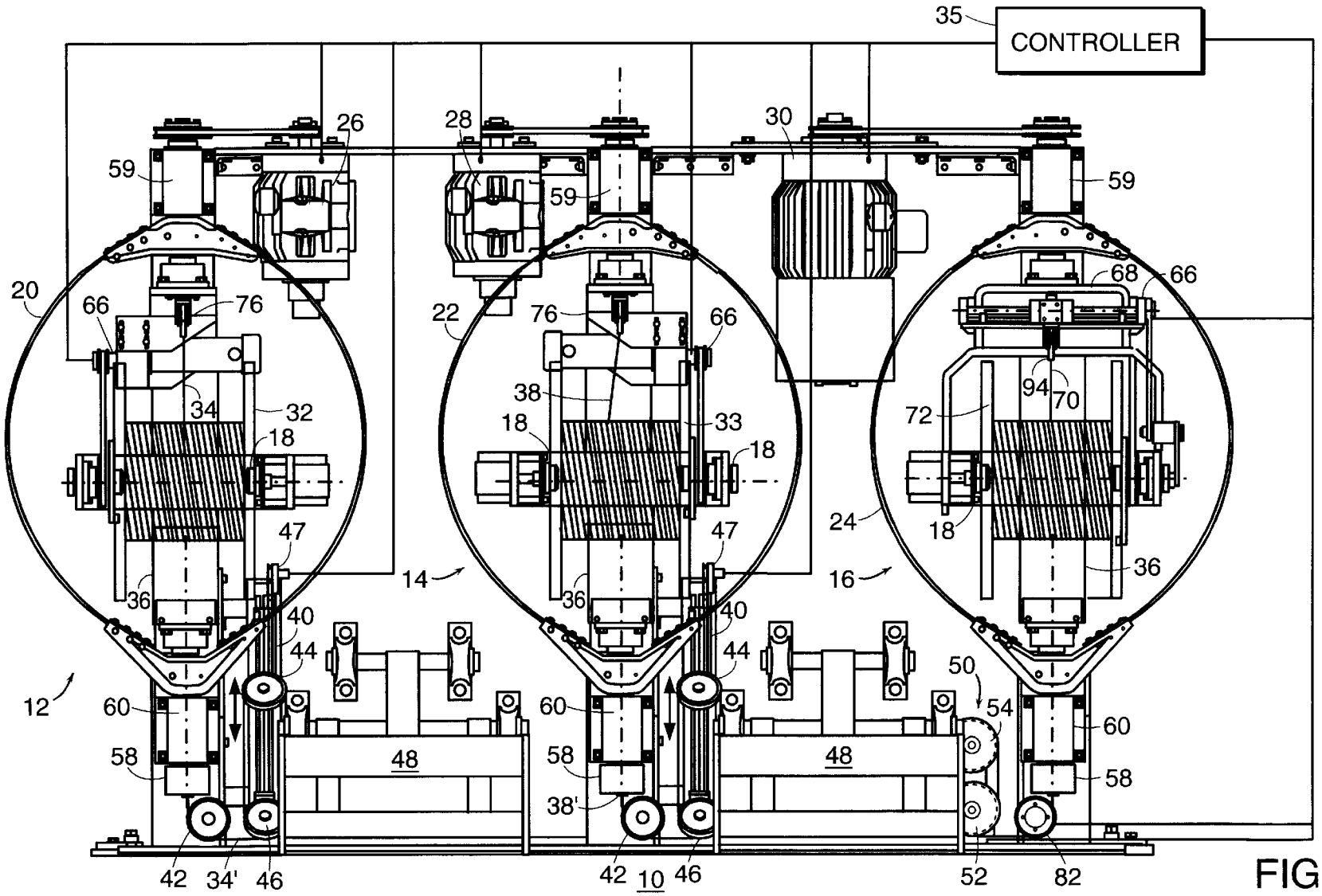
FIG. 1 is a front view of a double twist twinner with integral back twist payoffs and intervening capstan in accordance with the present invention.
Figure 2:
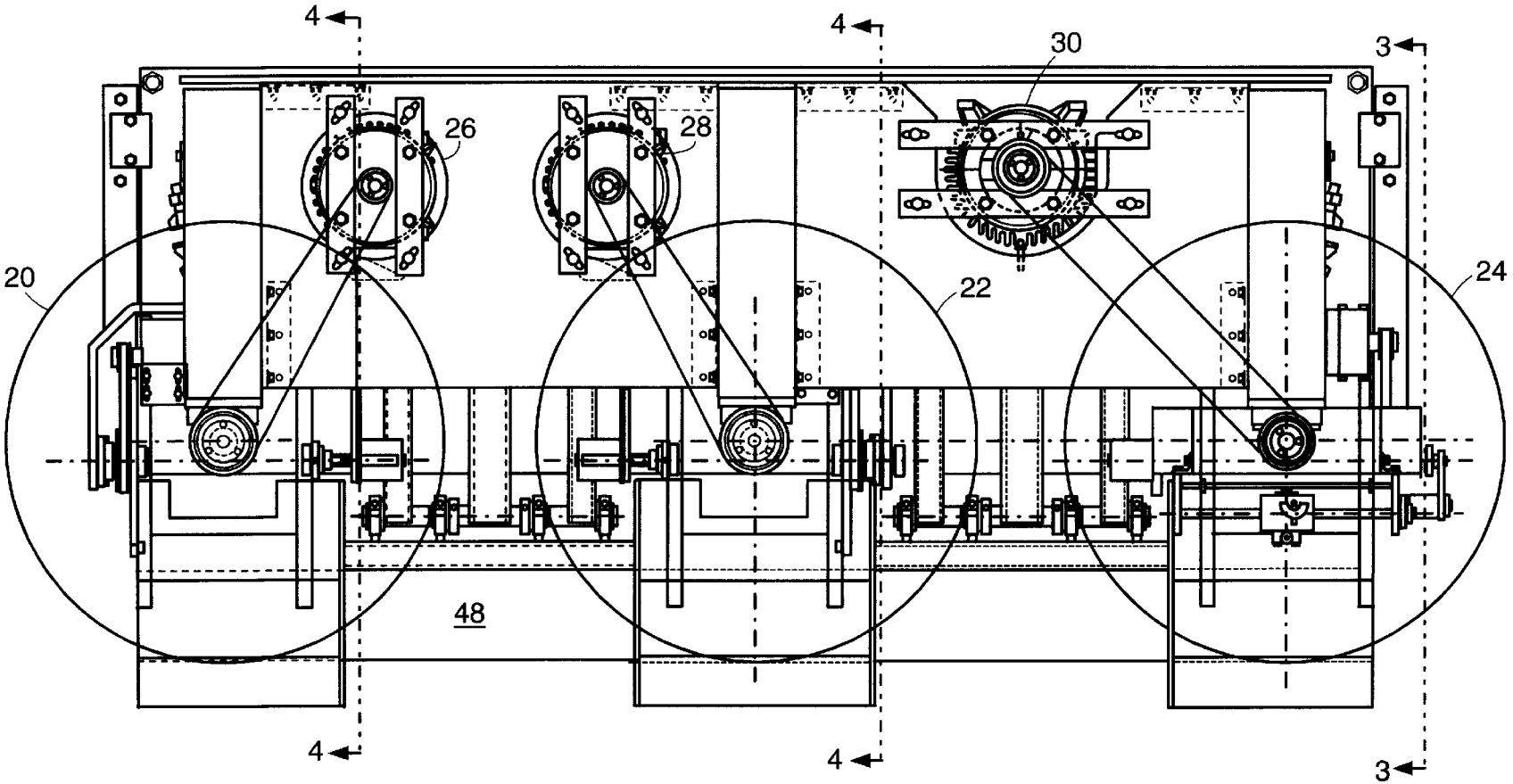
FIG. 2 is a top view of the inventive twinner of FIG. 1.

Turning to the figures, FIG. 1 depicts a twisting apparatus comprising a double twist twinner with integral back twist payoffs, generally referred to by reference numeral 10, which has been constructed according to the principles of the present invention. Twisting apparatus 10 includes a first back payoff twister 12, a second back payoff twister 14, and a twinning device/cabler 16. Generally, twisters 12 and 14 dispense respective wires 34, 38 and impart a back-twist to the same, the back-twisted wires referred to by respective numerals 34' and 38'. These wires are pulled at a substantially constant rate by a capstan assembly 50, which can also be referred to as a metering device, and twisted and twinned (also referred to as pairing) together and taken-up by twinning device 16.

Figure 4:
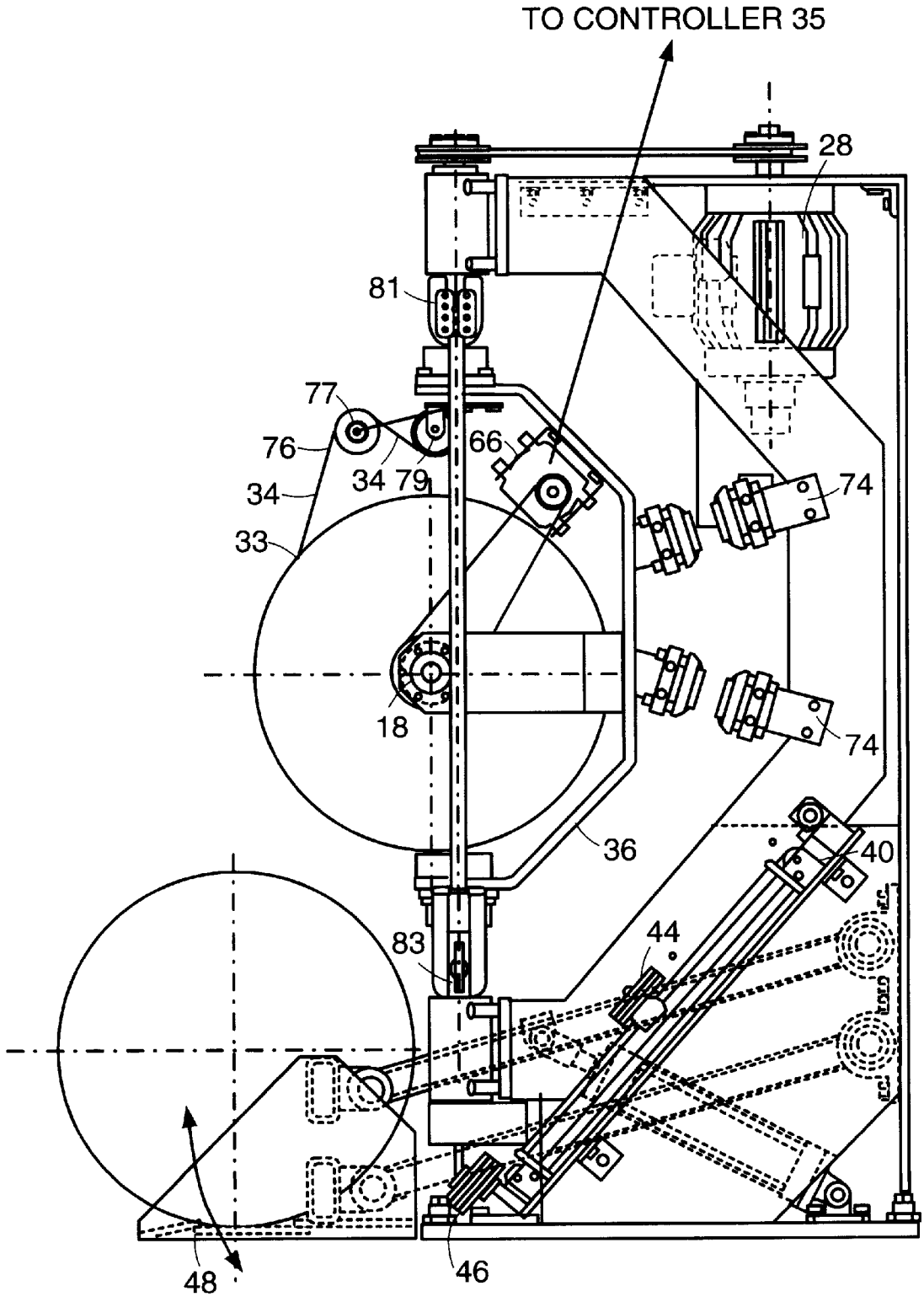

More particularly, wires 34 and 38 are wrapped about respective pay-off reels 32, 33 and held in the cradle assembly 36 of twisters 12, 14 by idler pintle assemblies 18. Idle pintle assemblies 18 of twisters 12, 14 are rotated by motors 66 (best seen in FIG. 4) which are controlled by controller 35. Wires 34, 38 pass through fleeting pulley assemblies 76 or damping mechanism to take-up slack in the dispensing of the wires.

In a typical implementation, wires 34, 38 are insulator-coated conductors. Typically, the conductors are copper. The insulator is typically a thermoplastic or other equivalent resin that has been extruded to continuously coat the conductors.

In a preferred embodiment of the present invention, pulley assemblies 76 each include a pulley 77 attached to spring steel, which is biased upwards such that the pulley 77 takes-up any slack in the respective wires 34, 38. Wires 34, 38 pass around pulleys 77, 79 and over pulleys 81. Pulleys 77 are positioned on cradle assembly 36 which are held stationary by magnet assemblies 74. Pulleys 81 are positioned within respective wire guide bows 20, 22 which are rotatably supported by a lead-in spindle assembly 59 and a lead-out spindle assembly 60. The lead-out spindle assemblies 60 include slip ring assemblies 58. Bows 20, 22 are rotated by respective motors 26, 28, which are controlled by controller 35.

Because pulleys 79 are stationary and pulleys 81 rotate with the bows 20 and 22, the wire is twisted therebetween. Wires 34, 38 are threaded along the interior surface of respective bows 20, 22 and pass over pulleys 83 which are positioned at the bottom of the bows. Wires 34, 38 pass through the lead-out assemblies 60 and pass around exit pulleys 42. Wires 34, 38 are again twisted between pulleys 83 and 42 resulting in back-twisted wires 34', 38'. Since the wires are twisted at the top and bottom of bows 20, 22, one twist per complete revolution of bows 20, 22, twisters are commonly referred to as "double twist bows."

Before the back-twisted wires 34', 38' are wrapped around and pulled by capstan 50, the wires are threaded around a buffer assembly or dancer 40 which takes up any slack between exit pulleys 42 and capstan 52. Dancer 40 includes a stationary pulley 46 and a pulley 44 moveable in the direction of the double-headed arrows. The position of pulleys 44 are detected by a potentiometer 47 connected to controller 35. If capstan 50 pulls wires 34', 38' at a faster rate, pulley 44 would move toward pulley 46 precluding the wires from being stretched out of specification. The potentiometer 47 forwards the movement of pulley 44 to controller 35 wherein the controller directs motors 66 to pay-off wire at a faster rate. Similarly, if capstan 50 pulls wires 34', 38' at a slower rate, pulley 44 would move away from pulley 46 to thereby control wire tension and prevent slack in the wires. The controller 35 would then direct motors 66 to pay-off wire at a slower rate.

Figure 5:
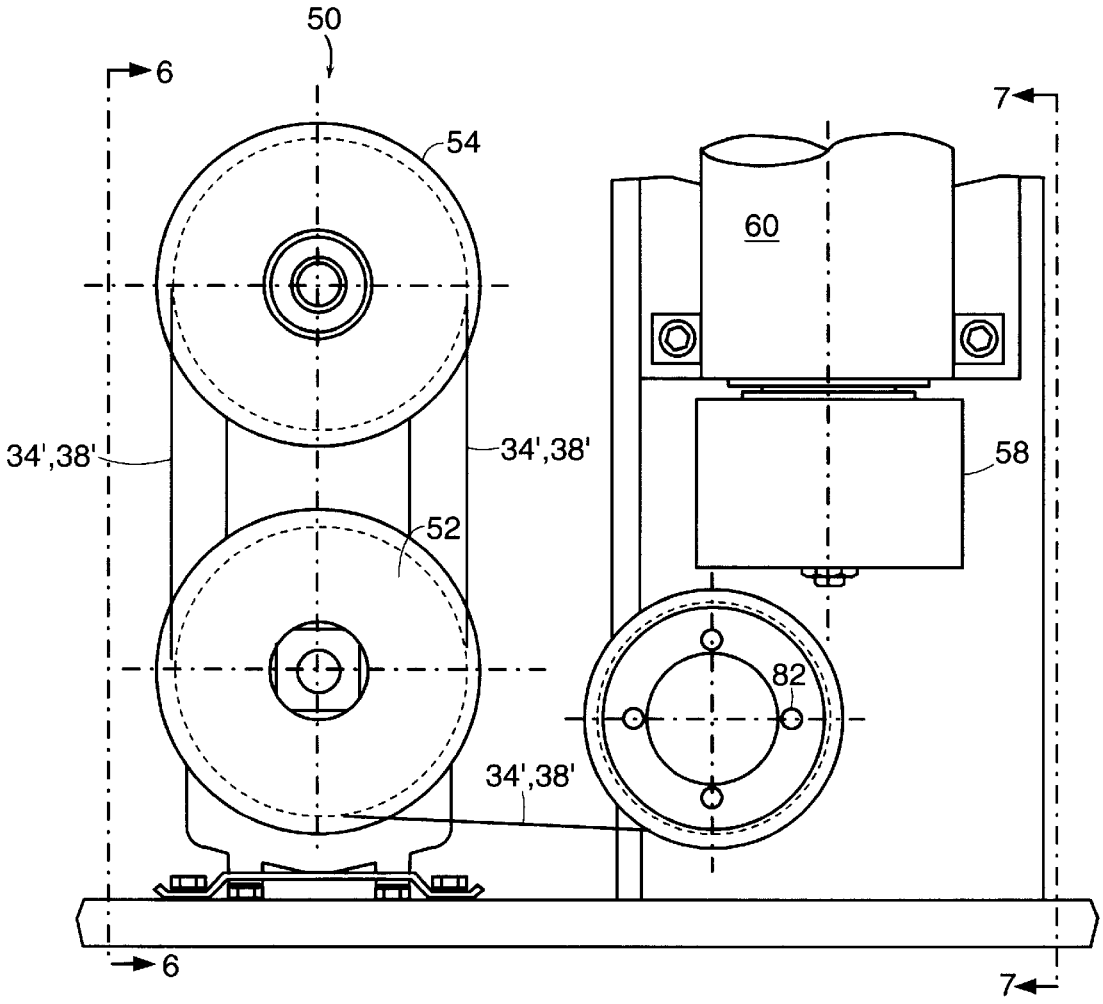
FIG. 5 is a front view of the capstan assembly and tension transducer shown in FIG. 1.
Figure 6:
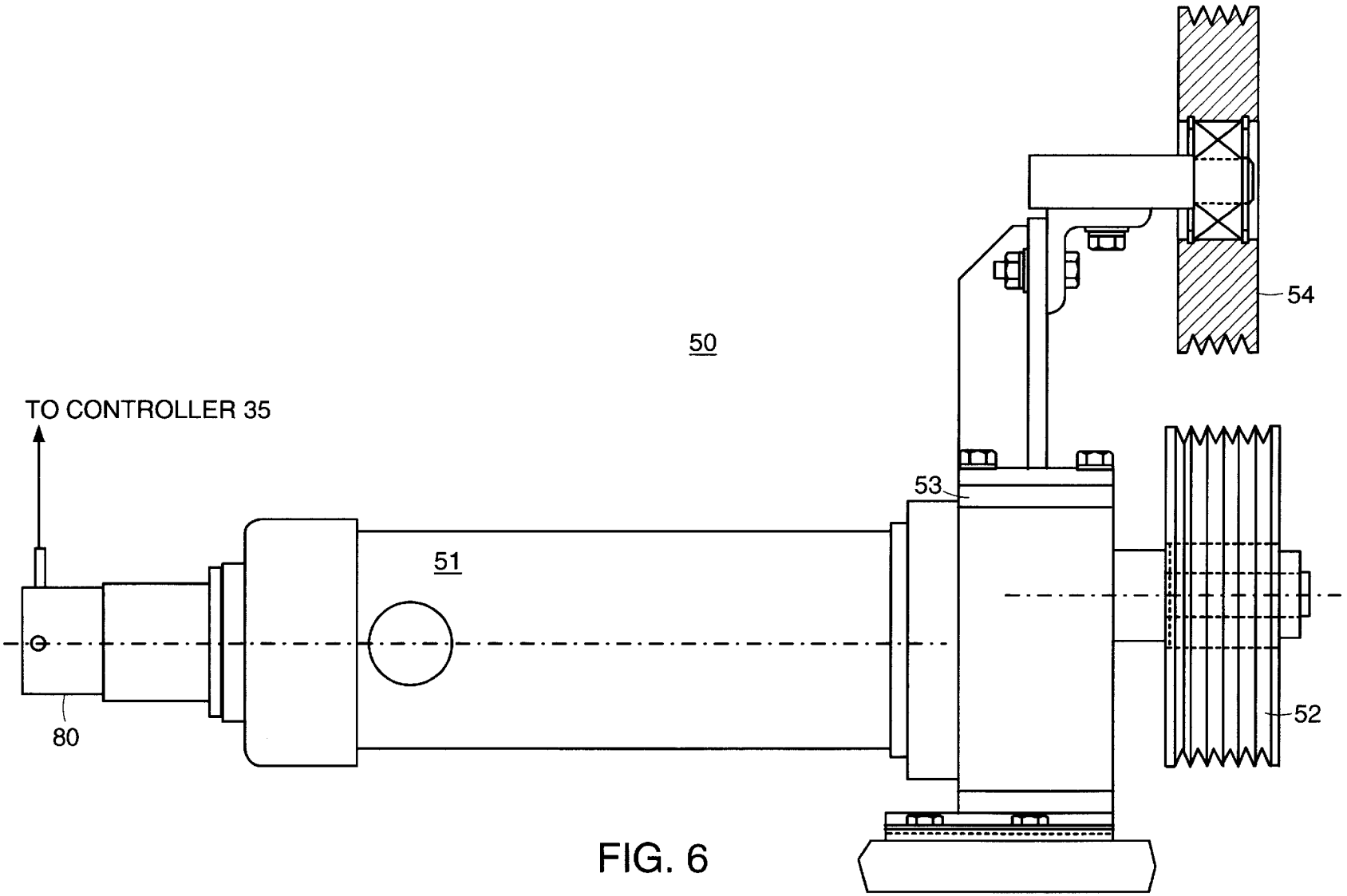
FIG. 6 is a partially cutaway side view of the capstan assembly taken along line 6—6 of FIG. 5.

The pre-twisted wires 34', 38' are pulled by capstan 50 which is controlled by controller 35. FIGS. 5 and 6 illustrate the capstan 50 in more detail. Capstan 50 includes a drive capstan wheel 52 attached to and rotated by drive motor 51. An idler capstan wheel 54 is provided journaled to a capstan frame 53. An encoder 80 measures the speed at which motor 51 is rotating and forwards the signal to controller 35. In a preferred embodiment of the present invention, wires 34', 38' are wrapped around wheels 52 and 54 a total of three times to ensure that the wires do not slip, are pulled at the same velocity, and reduce tension because of the mechanical advantage associated with the pulley system.

Figure 7:
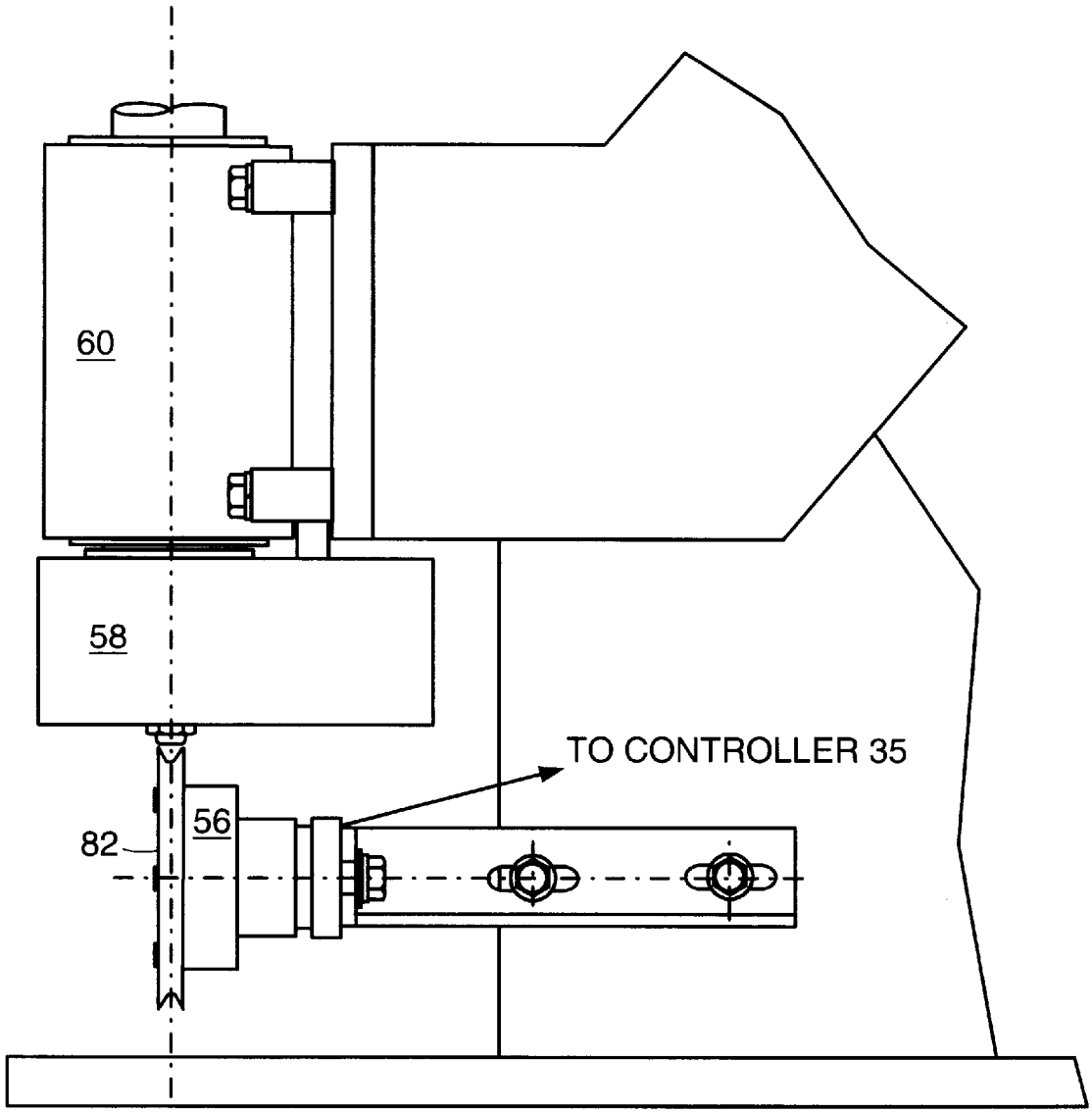
FIG. 7 is a side view of the tension transducer taken along line 7—7 of FIG. 5.

As particularly illustrated in FIGS. 5 and 7, wires 34', 38' pass around pulley 82 of tension transducer 56 prior to entering the twinning device 16. Tension transducer 56 measures the tension in the wires and forwards this measurement to controller 35. In alternative embodiments, the wire tension is measured by a detector in pulleys in the traverse mechanism 68 or by measuring capstan motor current draw. These measurements can be used to supplement or replace information from pulley 82.

Figure 3:
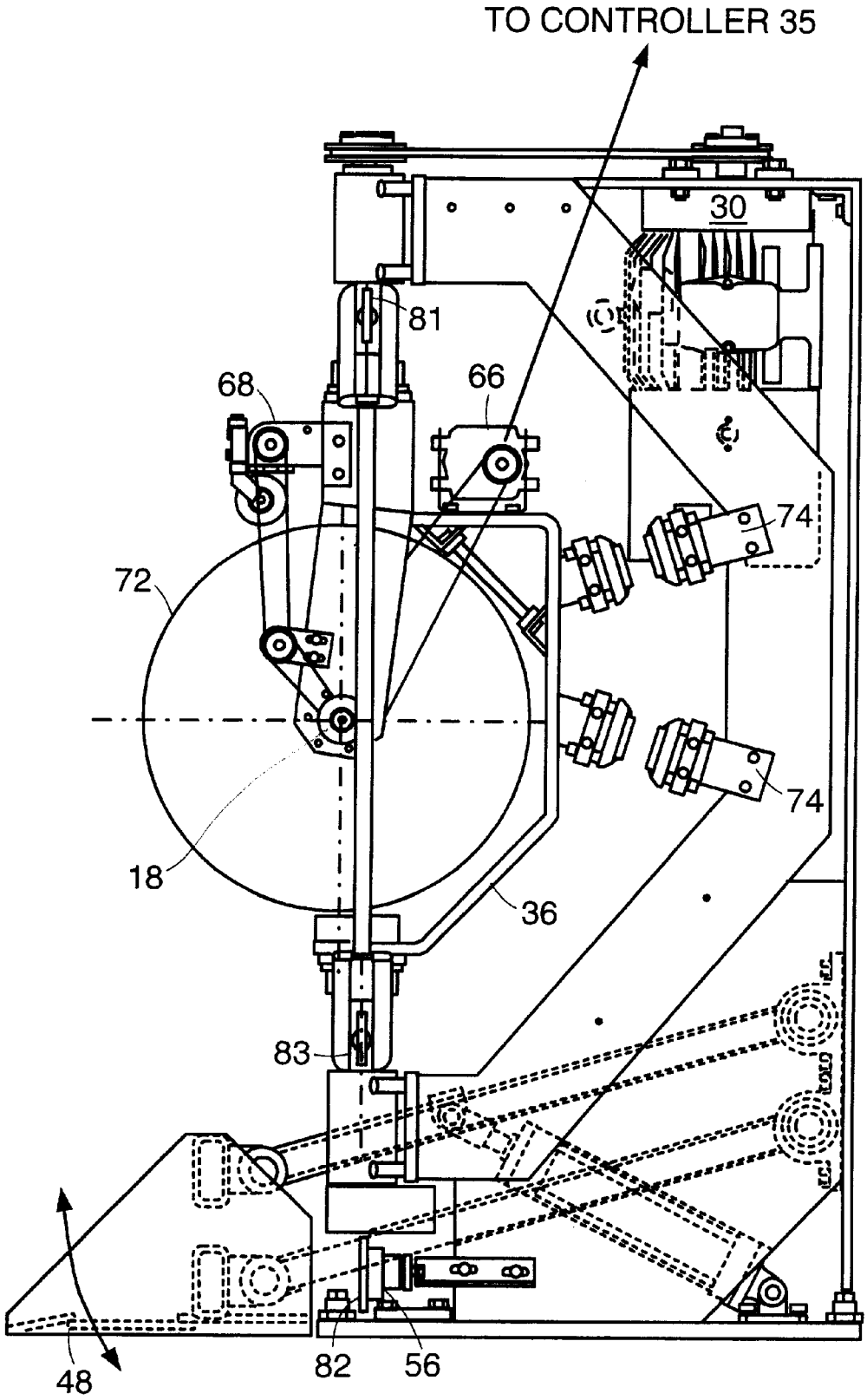
FIGS. 3 and 4 are partial cutaway views taken along lines 3—3 and 4—4, respectively, of FIG. 2.

Referring again to FIG. 1, twisting device 16 has similar features as found in twisters 12 and 14 wherein the same reference numerals refer to the same or similar elements. Twisting device 16 twins or pairs pre-twisted wires 34', 38' and wraps the resulting twisted, cabled pair 70 onto take-up reel 72. Twisting device 16 is also a double twister in that it twists and pairs the wires between pulleys 82 and 83 at the lower end and also twists the wires between pulley 81 (best seen in FIG. 3) and pulley 96 (best seen in FIG. 9) at the upper end of the device. Wire guide bow 24 is rotated by motor 30 controlled by controller 35.

Figure 8:
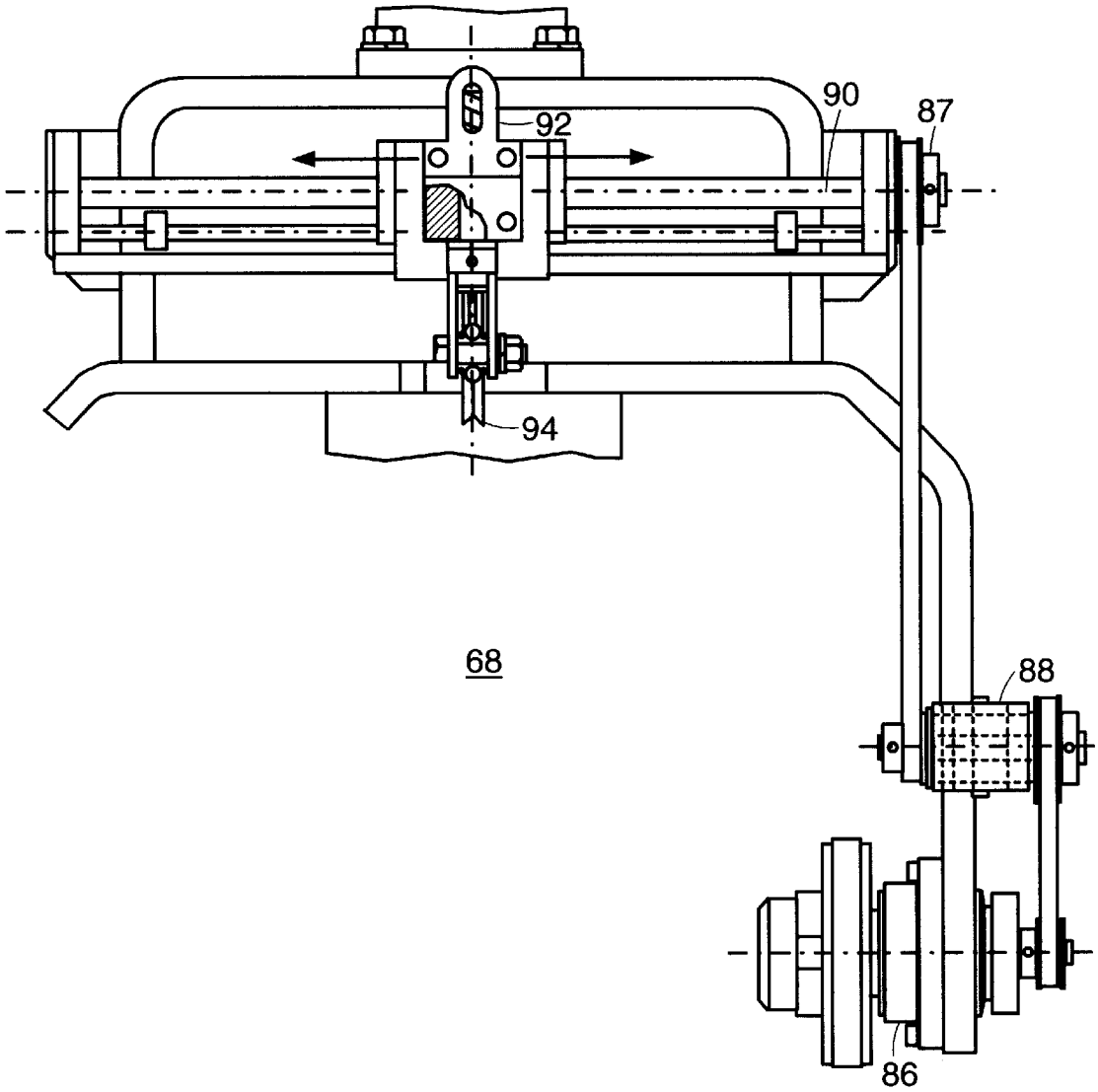
FIGS. 8–10 are front, side, and top views, respectively, of the traverse mechanism shown in FIG. 1.
Figure 9:
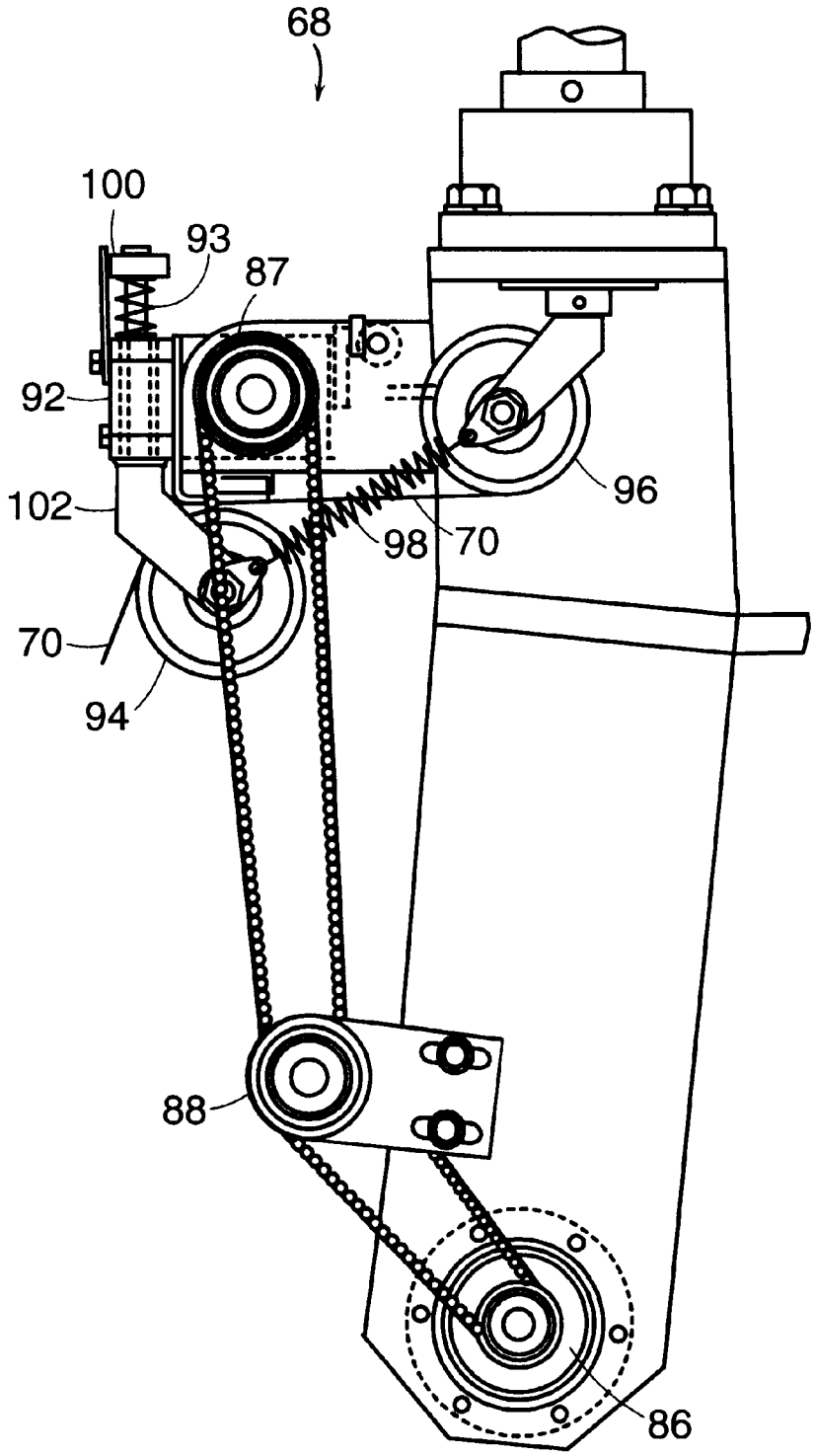
Figure 10:
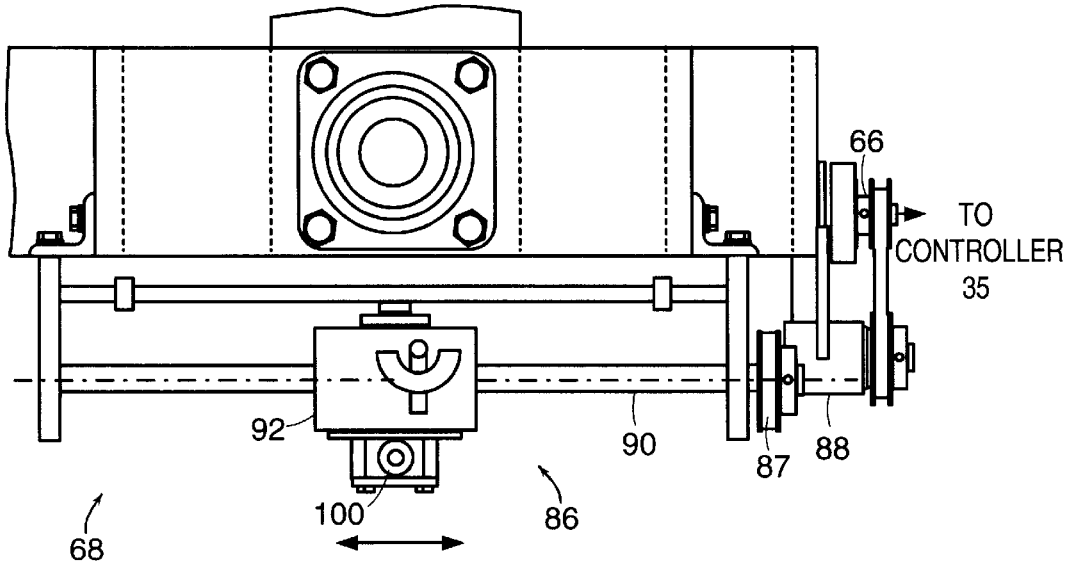

As best illustrated in FIGS. 8–10, a traverse assembly 68 is also provided on twinning device 16 to lay cabled pair 70 onto take-up reel 72. Traverse assembly 68 includes a traverse member 92 slidable along shaft 90. Member 92 is driven by motor 66 via traverse members 86, 88 and traverse pulley 87. As best seen in FIG. 9, member 92 slidably supports member 102 which rotatably supports pulley 94. A spring 93, held in place by collar 100, resiliently biases member 92 upwards. The cabled pair 70 passes around pulley 96 and over pulley 94 and then it is wound onto take-up reel 72. Spring 98 interconnects and linearly aligns pulleys 94 and 96. Spring 94 can move downward to prevent the cabled pair 70 from being overstretched. A mechanical damping system is also provided to reduce oscillations.

The twisting apparatus 10 of the present invention provides the capstan 50 on the outside of twinning device 16. That is to say, the capstan pulls pre-twisted wires 34', 38' from pay-off reels 32, 33 before they are cabled together. Unlike prior art systems, this facilitates the reduction in tension on the wires as they pass through twinning device 16. Reduced tension of the wires through twinning device 16 is desirable because the extreme forces, e.g., centrifugal, in the twinning device increase friction between the wire and bow. Increased tension results in an increase in the force that must be used to pull wires 34', 38' through the bow 24. This, in turn, affects the electrical characteristics of the twisted pair. Specifically, this tension tends to distort the manner in which the wires are twisted together. For example, the insulation can be compressed to some degree, which reduces the electrical isolation between the wires. In contrast, when the wires are twisted together under reduced tension, the electrical characteristics improve.

By placing the capstan 50 outside the twinning device 16, and specifically upstream of the twinning device, the tension placed on the partially twisted pair passing through bow 24 arises only due to the friction of the wire in the bow, especially when an enclosed bow is used, thereby reducing any tension resulting from atmospheric drag and turbulence. Effectively, the forces required to pull the wires from twisters 12, 14 is handled by the capstan 50. In fact, with proper control of the capstan 50 and the take-up control motor 66, the partially twisted pair through the bow 24 can be controlled to "float" to some degree.

By placing the capstan 50 outside the twinning device 16, the required bow 24 to line speed ratio can be fixed at its required setting. In a preferred embodiment of the present invention, wire guide bow 24 of the twining device 16 twists cabled pair 70 in the range of about 3,500 to 5,000 twists per minute (tpms), and most preferably about 4,500 tpms. Wire guide bows 20, 22 of twisters 12, 14 rotate in the range of 0% to 100% of the rotational speed of bow 24. The lower range (0%) results in no pre-twisting of the wires which is acceptable in applications such as paired telephone wire. The higher range (100%) is used to, for example, to neutralize a wire such that the twinning device untwists the pre-twisted wire. Preferably, bows 20, 22 rotate in the range of about 10%–25% of the rotational speed of bow 24, and most preferably about 20%. Preferably, the cabled pair 70 lay, defined as the distance in which each of the paired wires makes one complete 360 degree revolution about a common axis, is in the range of about ¼" to 1". Also in accordance with a preferred embodiment of the present invention, capstan pulls wires 34', 38' with a tension of approximately three pounds.

Figure 11:
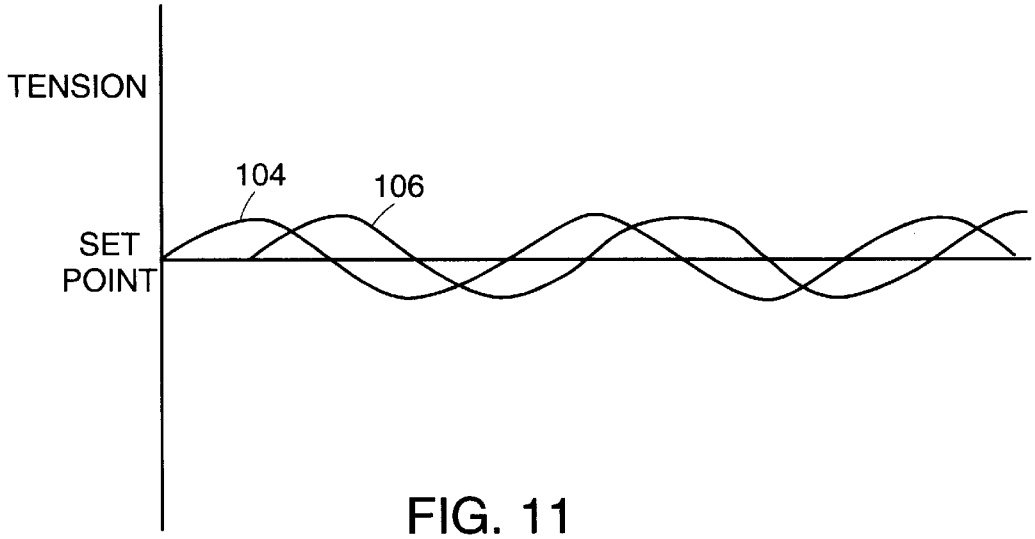
FIG. 11 is a graph illustrating the oscillating tension on the wire and inverse control signal to the take-up reel motor as it is pulled through the double twist twinner.

As described above, the tension of wires 34', 38' is measured by the tension transducer 56 which forwards the measurement to the controller 35. It has been found that the tension of the wires within the twinning device 16 oscillates sinusoidally due to numerous variables including jerking of the wire as it is pulled through the wire guide bow 24. This oscillation is depicted graphically by reference numeral 104 of FIG. 11. The controller 35 is programmed to control take-up motor 66 in tension mode such that the sinusoidal fluctuations are minimized or canceled in twinning device 16. That is to say, the tension can be minimized by anticipating when a sag is going to occur and backing off the tension of take-up motor 66. This is graphically depicted by reference numeral 106. In effect, an inverse control signal is introduced to the take-up motor 66 proportional to the oscillation monitored by transducer 56.

The operation of the present invention will now be described. The operator rolls pay-off reels 32, 33 and take-up reel 72 onto pneumatically operated lifting assembly 48. Assembly 48 lifts the reels such that the operator can position them within the idler pintle assemblies 18 without substantial lifting. In alternative embodiments, the lifting assembly is not present and the operator manually lifts pay-off reels 32,33 into position. The operator then threads wires 34 and 38 through the fleeting pulley assemblies 76 over pulleys 81, around respective bows 20, 22 and around exit pulleys 42. Each wire is wound around respective dancer assembly 40, around capstan 50 and pulley 82 of tension transducer 56. The wires are threaded over pulley 83 and around bow 24 and through traverse assembly 68 and wound onto take-up reel 72. The operator initiates operation of the twisting operation 10 at controller 35. As the tension transducer 56 measures the dynamic tension of the wires, the controller 35 initiates a pre-programmed inverse control signal to take-up motor 66 to minimize tension oscillations within the twinning device 16.

Figure 12:
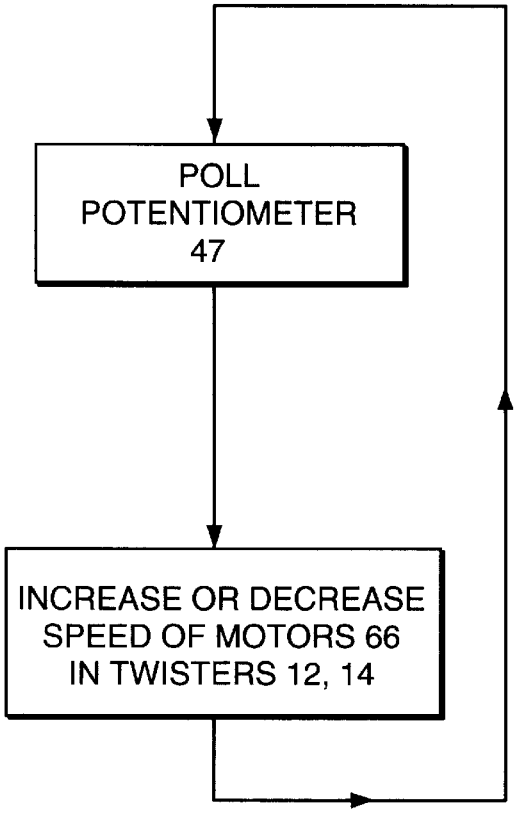
FIG. 12 is a flow diagram illustrating the operation of the controller of FIG. 1 and the control algorithm used to control the speed of pay-off motors.

FIG. 12 is a flow diagram illustrating the operation of the controller 35 and the control algorithm used to control the speed of motors 66 in twisters 12, 14. Specifically, the controller 35 polls the potentiometer 47 in each of twisters 12, 14. These potentiometers 47 indicate the amount of wire 34, 38 that is held in buffer or dancer assemblies 40. The speed of motors 66 is controlled to maintain a predetermined amount of buffered wire 34, 38.

Figure 13:
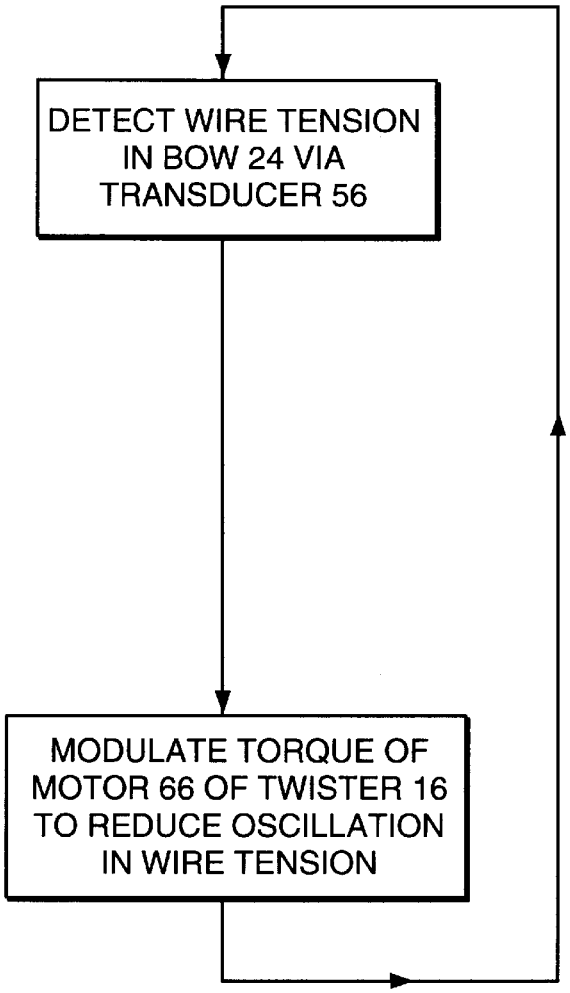
FIG. 13 illustrates a control algorithm for the controller with respect to the take-up motor and capstan.

FIG. 13 illustrates a control algorithm for the controller 35 with respect to the take-up motor 66 and capstan 50. Specifically, the controller 35 detects wire tension in the bow 24 indirectly by a transducer 56 on pulley 82. The controller 35 further monitors the speed of capstan 50. The controller 35 then modulates the torque or tension of take-up motor 66 in twinning device 16 to maintain the proper tension of the wire in twinner 16, specifically through the bow 24 and onto the take-up reel 72. Specifically, the torque or tension of motor 66 of twinning device 66 is modulated dynamically to reduce and remove any oscillations in the wire tension. Specifically, there is a resonant frequency associated with wire tension through the bow 24 due to the elasticity of the bow, and spring-like nature of the paired wire. The motor 66 is modulated to modulate the wire tension at this frequency of oscillation, but out of phase with the oscillations, for example, 90 degrees, to reduce these periodic tension fluctuations.

Industry specifications regarding the lay of the cabled pair 70 are particularly stringent, e.g., accuracy to within three decimal places. Modulation of the capstan 50 to remove or minimize the paired wire tension oscillations is possible, but not preferred, as such modulation directly affects the input speed of wires 34', 38' into the twinning device 16. This fluctuation in the input speed of the wires can affect the lay of cabled pair 70. Thus, the present invention provides a capstan 50 on the outside of the twinning device 16 capable of providing a pair of wires to the twinning device at a constant rate. A take-up reel motor 66 on the inside of the twinning device 16 controls the tension of the wires inside the device to minimize tension therethrough.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. An apparatus, comprising:

a first twisting device that dispenses a first wire and imparts a twist to the same;

a second twisting device that receives the first wire and twists the same about a second wire; and a metering device positioned on the outside of the second twisting device that controls the input velocity of the first and second wires.

2. The apparatus of claim 1, further comprising a third twisting device that dispenses the second wire and imparts a twist to the same.

3. The apparatus of claim 2, wherein the first and third twisting devices impart a back-twist to the first and second wires.

4. The apparatus of claim 2, wherein the second twisting device receives the first and second wires and twins the same.

5. The apparatus of claim 4, further comprising a transducer that measures the tension of the first and second wires before the second twisting device twins the same and forwards the tension measurement to a controller.

6. The apparatus of claim 5, wherein said second twisting device further comprises:

a take-up reel which accepts the twinned first and second wires; and a take-up reel motor which takes-up the twinned first and second wires in response to a control signal from the controller to minimize tension of the first and second wires through the second twisting device.

7. The apparatus of claim 1, wherein the second twisting device includes a traverse assembly to lay the first and second wires onto a take-up reel.

8. The apparatus of claim 7, wherein the traverse assembly includes a damping mechanism to maintain the tension in the first and second wires substantially constant.

9. The apparatus of claim 6, wherein the first and third twisting devices each include a pay-off reel that dispenses the first and second wires, each pay-off reel being rotated by a respective pay-off reel motor, the first and third twisting devices each further including a damping mechanism that takes up slack in the dispensing of the first and second wires.

10. The apparatus of claim 2, wherein each twisting device includes a bow assembly rotated by a respective motor for twisting the wires.

11. The apparatus of claim 2, wherein each twisting device is vertically oriented.

12. The apparatus of claim 2, wherein the first and third twisting devices each include a dancer assembly that takes up slack in the dispensing of the first and second wires.

13. The apparatus of claim 9, further comprising a lifting device to lift the pay-off and take-up reels into place.

14. The apparatus of claim 1, wherein the metering device includes a capstan including an encoder to measure the speed of the first and second wires.

15. An apparatus, comprising:

first twisting means for dispensing a first wire and imparting a twist to the same;

second twisting means for receiving the first wire and twisting the same about a second wire; and metering means positioned on the outside of the second twisting device for controlling the input velocity of the first and second wires.

16. The apparatus of claim 15, further comprising third twisting means for dispensing the second wire and imparting a twist to the same.

17. The apparatus of claim 16, wherein the first and third twisting means impart a back-twist to the first and second wires.

18. The apparatus of claim 15, further comprising transducer means for measuring the tension of the first and second wires before the second twisting twists the same and forwarding the measurement to a controller, the controller controlling the tension of a take-up reel motor that takes up the twisted wires such that the tension through the second twisting means is substantially constant.

* * * * *